US005713810A

United States Patent [19]

Fedorka et al.

[11] Patent Number: 5,713,810

[45] Date of Patent: Feb. 3, 1998

[54] BELT LIFTER

[75] Inventors: Thomas J. Fedorka, Medina; Robert B. Meyer, Middleburg Heights, both of Ohio

[73] Assignee: The Scott Fetzer Company, Westlake, Ohio

[21] Appl. No.: 644,189

[22] Filed: May 10, 1996

[51] Int. Cl.[6] ..... A47L 9/22

[52] U.S. Cl. ..... 474/129; 15/246.2

[58] Field of Search ..... 474/129, 135, 474/138; 15/246.2, 361, 410, 143.1

[56] References Cited

U.S. PATENT DOCUMENTS 4,686,736 8/1987 Petralia et al. ..... 15/332

5,012,632 5/1991 Kuan et al. ..... 474/135 X

*Primary Examiner*—Roger J. Schoeppel

*Attorney, Agent, or Firm*—Jones, Day, Reavis & Pogue

[57] ABSTRACT

A belt lifter for a vacuum cleaner includes a rotatable member attached to an extending arm for lifting a drive belt on and off of a drive shaft to respective connect and disconnect the belt. The rotatable member includes a lever arm which facilitates the rotation of the extending arm by providing a mechanical advantage. The lever arm is of sufficient length so as to permit hand gripping by an operator. The lever arm is movable between an operating position and a stowed position.

8 Claims, 3 Drawing Sheets

BELT LIFTER

BACKGROUND OF THE INVENTION

The present invention is directed to the field of belt lifter devices for disengaging a drive belt from a drive member, such as a rotating drive shaft. The present invention has particular applicability as a belt lifter for disengaging a drive belt used to rotate a roller brush in a vacuum cleaner.

Belt lifters are known for facilitating the connection and disconnection of belts from a drive shaft, particularly as used for vacuum cleaners. As seen in FIG. 1, such belt lifters 10 typically include a rotatable member 12, attached to the roller brush housing 14, and an extending arm 16 which extends approximately perpendicular to the axis of rotation of the rotatable member 12. Upon rotation, the extending arm 16 contacts the belt 18 and lifts it onto or off of the drive shaft 20, thus providing a simple method of connection between the drive shaft 20 and the roller brush 22 as compared to manually connecting the two elements. By disconnecting the belt from the drive shaft, the belt lifter permits the vacuum cleaner nozzle head to be easily removed and replaced with another type of nozzle head, e.g. a shampooer or a polisher.

Common types of belt lifters are operated by rotating a dial 24 on the exterior of the housing, which is attached concentrically to the rotatable member 12. Other types of belt lifters include "tabs" or "ears" which are mounted around the periphery of the dial. These tabs facilitate rotation by providing a type of handle for gaining a more secure finger grip around the rotatable member.

However, such previous belt lifters having dials and tabs are not suited for all users. Previous belt lifters require a fair amount of strength in the hands and fingers in order to lift the belt on and off of the drive shaft. It has been found that older people or persons with disabilities and conditions such as arthritis have a difficult time rotating the previous belt lifters. Thus, the applicability and usefulness of a belt lifter is not available to all potential operators.

SUMMARY OF THE INVENTION

In view of the difficulties and drawbacks associated with previous belt lifters, it would be advantageous to provide a belt lifter which solves the previous problems while providing more efficient operation.

Therefore, there is a need for a belt lifter which has universal applicability and usefulness over a broad range of operators.

There is also a need for a belt lifter which has an improved mechanical advantage.

There is also a need for a belt lifter having a hand-grippable rotatable member.

These needs and others are realized by the belt lifter of the present invention in which the rotatable member includes a lever arm which facilitates the rotation of the extending arm by providing a mechanical advantage. The lever arm is of sufficient length so as to permit hand gripping by an operator. The lever arm is movable between an operating position and a stowed position. The belt lifter of the present invention is particularly intended for, but not limited to the use of, a vacuum cleaner.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1:
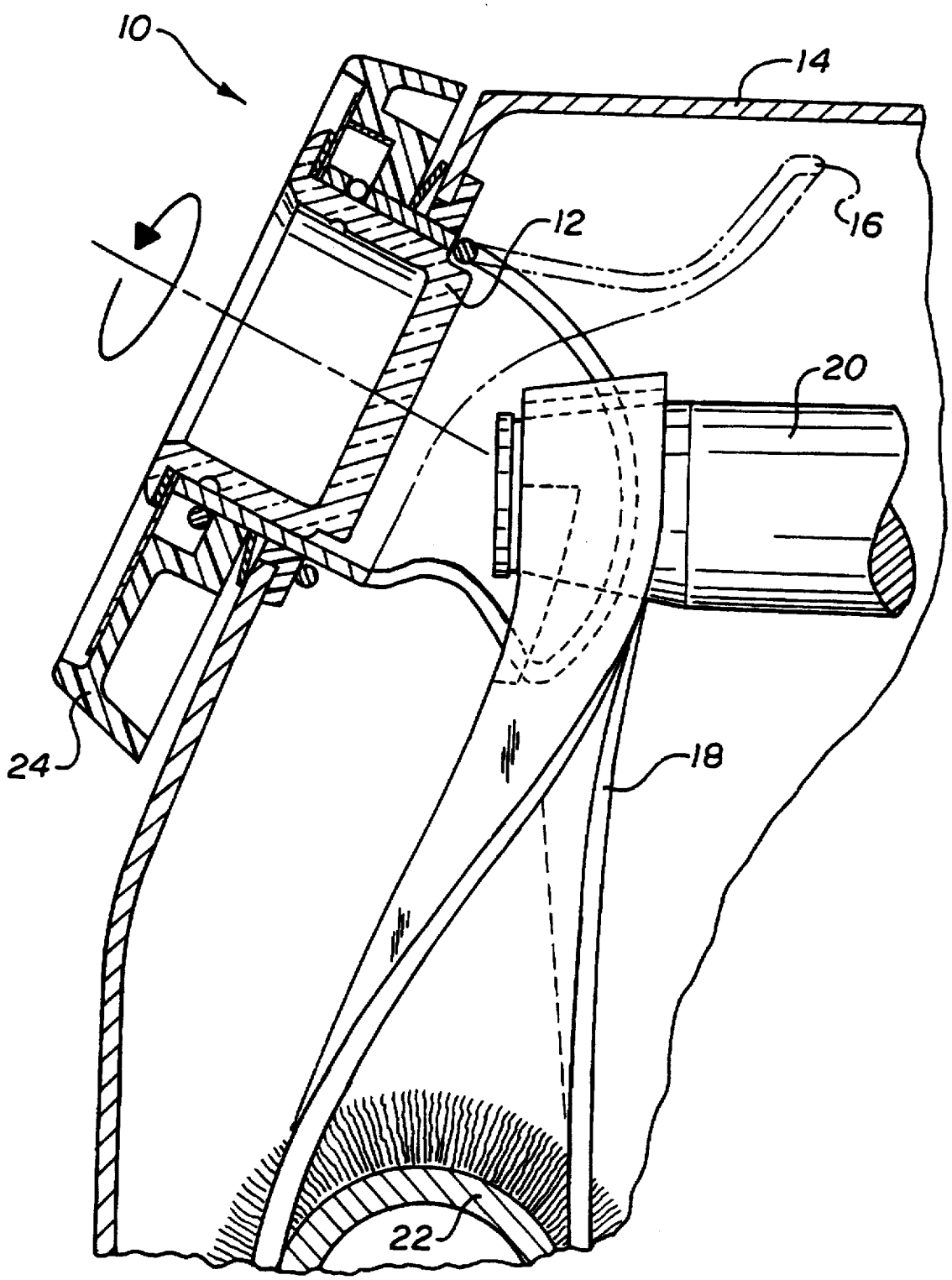
FIG. 1 is a side sectional view illustrating a previous type of belt lifter and its operation.
Figure 2A:
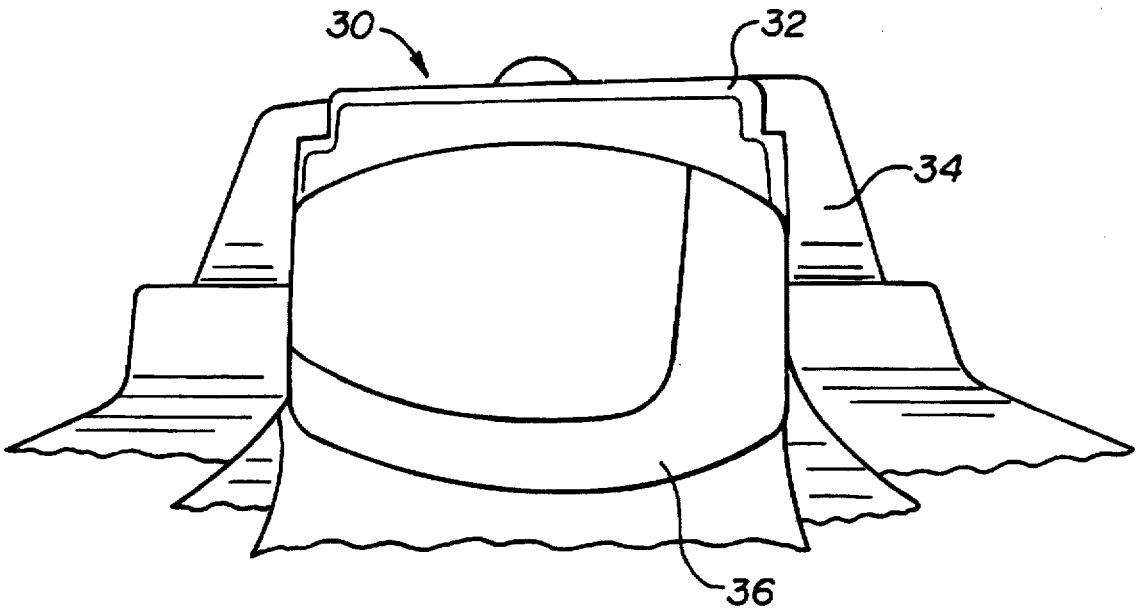
FIGS. 2A and 2B are frontal views showing the construction of the belt lift as according to the present invention.
Figure 2B:
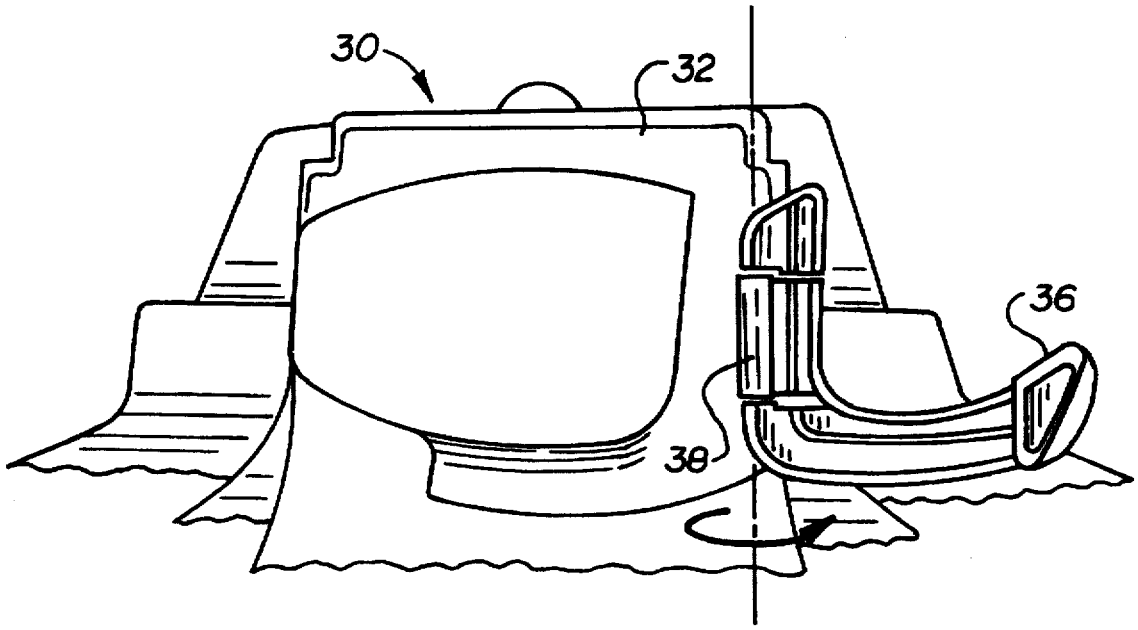

We refer now to the drawings which are for purposes of illustrating only the preferred embodiment of the present invention and not for purposes of limiting the same. FIGS. 2A and 2B show a belt lifter 30 which includes a dial 32 which is attached to a rotatable member 12 and an extending arm 16 such as are also shown in FIG. 1. The present belt lifter 30 is secured to the present roller brush housing 34, and is rotatable there around. The present belt lifter includes a lever arm 36 which is pivotally movable between an operating position (as shown in FIG. 2B) and a stowed position (as shown in FIG. 2A). The lever arm 36 pivots about a hinge 38 which is mounted on the dial 32.

The lever arm 36 is preferably about three inches in length from the hinge, thereby permitting an operator to gain a secure hand grip, and also offering a significantly longer moment arm for applying leverage to the belt lifter 30. In this way, the present belt lifter 30 is significantly easier to use over previous belt lifters. The present lever arm 36 is also preferably shaped to form an inconspicuous and decorative part of the dial 32 when in the stowed position.

Figure 3A:
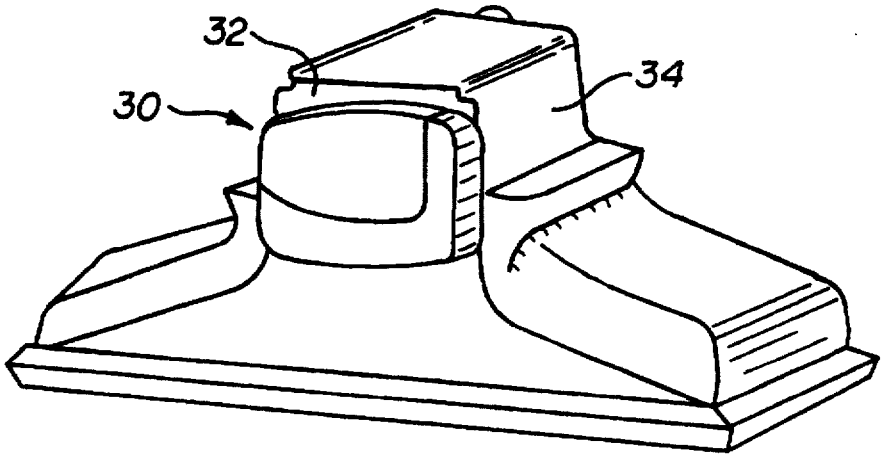
FIGS. 3A, 3B and 3C are oblique views showing the belt lifter and its operation as according to the present invention.
Figure 3B:
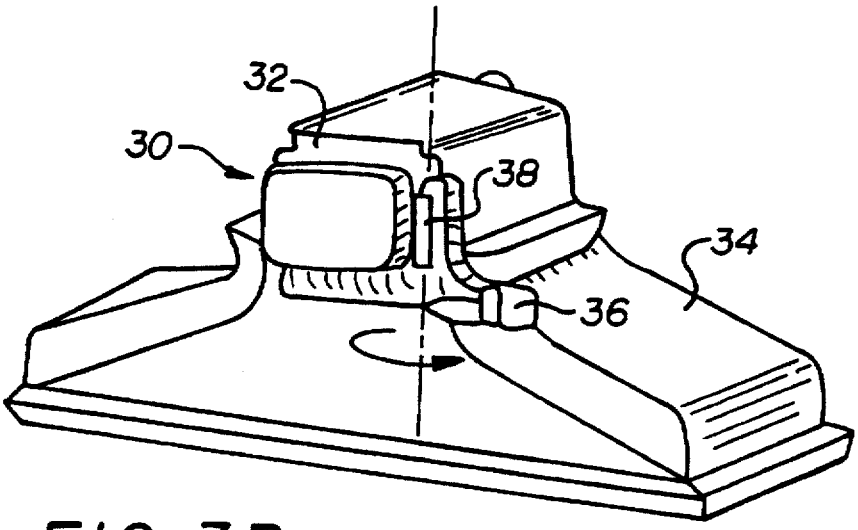
Figure 3C:
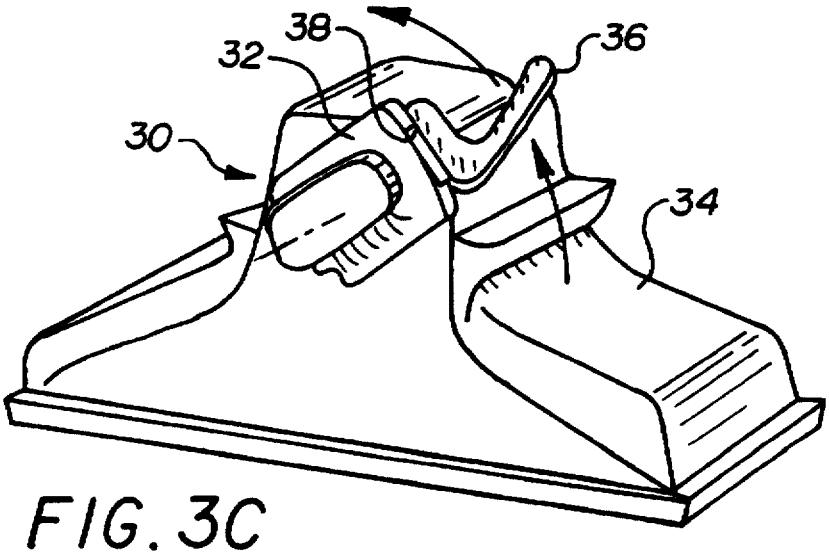

The operation of the present belt lifter 30 is shown in FIGS. 3A, 3B and 3C. FIG. 3A shows the stowed position. In FIG. 3B, the lever arm 36 is pivoted about its hinge 38 into the operating position. In FIG. 3C, the belt lifter 30 is rotated about its axis of rotation to alternately connect or disconnect the belt 18 from the drive shaft 20.

The belt lifter of the present invention can be operated with less strength than required for previous belt lifters. The lever arm of the present invention thus provides a mechanical advantage not attained in previous devices, permitting applicability and usefulness for older people and persons with disabilities and conditions such as arthritis. Thus, the present invention is highly advantageous as compared with previous belt lifters.

It should be appreciated that, while the present invention, as described hereinabove, solves many problems associated with previous belt lifters as used with vacuum cleaners, the invention should not be construed to be limited to vacuum cleaners alone. Certainly the present invention has applicability to all devices in which a drive belt must be manually disengaged from a drive shaft. It will also be appreciated that various changes in the details, materials and arrangements of parts which have been herein described and illustrated in order to explain the nature of the invention may be made by those skilled in the art within the principle and scope of the invention as expressed in the appended claims.

We claim:

1. A belt lifting mechanism for disengaging a drive belt from operative contact with a drive member, said belt lifting mechanism comprising:

a rotatable member fixedly mounted to a housing for rotational movement about an axis;

an extending arm formed integrally with said rotatable member and extending therefrom, wherein said extending arm is rotated about the axis between a non-engagement position and an engagement position where the extending arm lifts the drive belt out of operative contact with the drive member;

a lever arm pivotally attached to the rotatable member for facilitating the rotation of the extending arm by providing a mechanical advantage, wherein the lever arm is of sufficient length so as to permit hand gripping by an operator, and wherein the lever arm is movable between an operating position and a stowed position.

2. The belt lifting mechanism of claim 1 wherein the lever arm is attached to a dial which is connected to the rotatable member.

3. The belt lifting mechanism of claim 2 wherein the lever arm is pivotally attached to the dial with a hinge.

4. The belt lifting mechanism of claim 1 wherein the lever arm is about three inches in length.

5. A vacuum cleaner comprising:

a motor for creating an air flow to remove particulate matter from a surface to be cleaned;

a filter bag for depositing the particulate matter removed by the air flow;

a brush roller, received in a housing, for rotatably dislodging the particulate matter from the surface into the air flow;

a drive member, connected to the motor, and driving the brush roller with a drive belt;

a belt lifting mechanism for disengaging the drive belt from operative contact with the drive member, said belt lifting mechanism comprising:

a rotatable member fixedly mounted to the housing for rotational movement about an axis;

an extending arm formed integrally with said rotatable member and extending therefrom, wherein said extending arm is rotated about the axis between a non-engagement position and an engagement position where the extending arm lifts the drive belt out of operative contact with the drive member;

a lever arm pivotally attached to the rotatable member for facilitating the rotation of the extending arm by providing a mechanical advantage, wherein the lever arm is of sufficient length so as to permit hand gripping by an operator, and wherein the lever arm is movable between an operating position and a stowed position.

6. The vacuum cleaner of claim 5 wherein the lever arm is attached to a dial which is connected to the rotatable member.

7. The vacuum cleaner of claim 6 wherein the lever arm is pivotally attached to the dial with a hinge.

8. The vacuum cleaner of claim 5 wherein the lever arm is about three inches in length.

* * * * *